US005969612A

United States Patent [19]

Gadonniex et al.

[11] Patent Number: 5,969,612

[45] Date of Patent: Oct. 19, 1999

[54] STABILIZING THE POSITION OF AN ACTIVE ELEMENT IN A MAGNETOMECHANICAL EAS MARKER

[75] Inventors: Dennis M. Gadonniex, Delray Beach; Ming-Ren Lian, Boca Raton, both of Fla.; David N. Lambeth, Pittsburgh, Pa.; Robert C. O'Handley, Andover, Mass.; Wing K. Ho, Boynton Beach, Fla.

[73] Assignee: Sensormatic Electronics Corporation, Boca Raton, Fla.

[21] Appl. No.: 09/110,497

[22] Filed: Jul. 6, 1998

[51] Int. Cl.[6] ..... G08B 13/14

[52] U.S. Cl. ..... 340/572.6; 340/572.1; 340/572.3; 340/572.8; 340/571

[58] Field of Search ..... 340/572.1, 572.6, 340/572.8, 540, 572.3, 825.54, 571

[56] References Cited

U.S. PATENT DOCUMENTS 4,510,489 4/1985 Anderson, III et al. ..... 340/572
5,499,015 3/1996 Winkler et al. ..... 340/551
5,565,847 10/1996 Gambino et al. ..... 340/572.8
5,745,039 4/1998 Hof et al. ..... 340/590
5,812,065 9/1998 Schrott et al. ..... 340/825.54

*Primary Examiner*—Benjamin C. Lee
*Attorney, Agent, or Firm*—Robin, Blecker & Daley

[57] ABSTRACT

A magnetomechanical EAS marker is formed of a housing, a magnetostrictive active element in the housing and a bias element fixedly mounted on the housing. A central portion of the active element is secured to the housing to keep the active element from shifting in a longitudinal direction relative to the bias element and to keep ends of the active element spaced from the housing. The active element remains free to mechanically resonate in response to an EAS interrogation signal. The stable positioning of the active element prevents variations in the bias magnetic field due to shifting relative to the bias element, while keeping ends of the active element free from frictional damping due to mechanical loading from contact with the housing.

17 Claims, 3 Drawing Sheets

STABILIZING THE POSITION OF AN ACTIVE ELEMENT IN A MAGNETOMECHANICAL EAS MARKER

FIELD OF THE INVENTION

This invention relates to electronic article surveillance (EAS) systems, and particularly to EAS systems which operate by detecting mechanical resonance of magnetostrictive elements.

BACKGROUND OF THE INVENTION

It is well known to provide electronic article surveillance systems to prevent or deter theft of merchandise from retail establishments. In a typical system, markers designed to interact with an electromagnetic field placed at the store exit are secured to articles of merchandise. If a marker is brought into the field or "interrogation zone", the presence of the marker is detected and an alarm is generated.

One widely used type of EAS system employs magnetomechanical markers that include a magnetostrictive element. An example of a marker of this type is illustrated in schematic, exploded form in FIG. 1. Reference numeral 10 generally refers to the magnetomechanical marker of FIG. 1. As seen from FIG. 1, components of the marker 10 include a magnetostrictive active element 12 and a housing 14 which forms a recess or cavity 16 in which the active element 12 is placed. A bias or control element 18 is fixedly mounted to the housing 14 adjacent to the active element 12. An adhesive layer (not shown) may be applied to the bottom or top of the housing to secure the housing to an article of merchandise.

Both the active and bias elements typically are in the form of ribbon-shaped lengths of metal alloy. Known active elements are cut from melt-spun amorphous alloy ribbons, and exhibit soft magnetic properties and substantial magnetostriction. Bias elements should exhibit hard or semi-hard ferromagnetic properties.

The active element is fabricated such that it is mechanically resonant at a predetermined frequency when the bias element has been magnetized to a certain level. At the interrogation zone, a suitable oscillator provides an AC magnetic field at the predetermined frequency, and the magnetostrictive element mechanically resonates at this frequency upon exposure to the field when the bias element has been magnetized to the aforementioned level. The resulting signal radiated by the magnetostrictive element is detected by detecting circuitry provided at the interrogation zone.

A magnetomechanical marker of the type illustrated in FIG. 1, and an EAS system which operates with this type of marker, are disclosed in U.S. Pat. No. 4,510,489, issued to Anderson et al. The disclosure of the Anderson et al. patent is incorporated herein by reference.

EAS systems which use magnetomechanical markers have proved to be very effective. Systems of this type are sold by the assignee of this application under the brand name "ULTRA*MAX".

The Anderson et al. patent points out the need to form the housing for the marker so that the mechanical resonance of the active element is not mechanically damped. That patent also teaches that the marker should be formed so that the bias element does not mechanically interfere with the vibration of the active element.

Although it is necessary to provide some freedom of movement for the active element, this requirement can lead to problems in operation of EAS systems which use magnetomechanical markers. One problem arises from the fact that the resonant frequency of the active element tends to be somewhat sensitive to variations in the bias field applied to the active element. If the active element shifts relative to the bias element, particularly in the longitudinal direction of the element, there may be a change in the resonant frequency of the active element so that the resonant frequency departs from a nominal frequency at which the marker is to be detected. As a result, detection of the marker may be compromised.

In addition, the marker, in actual use, may be placed so that the long dimension of the housing is vertically oriented. As a result, the lower end of the active element is likely to come into contact with a side of the housing, resulting in a mechanical loading of the lower end of the active element. This loading of the end of the active element may tend to cause frictional damping of the mechanical resonance of the active element, reducing the amplitude of the signal generated by the active element and potentially interfering with detection of the marker.

OBJECTS AND SUMMARY OF THE INVENTION

It is accordingly an object of the invention to provide an improved magnetomechanical EAS marker.

A more specific object of the invention is to provide a magnetomechanical EAS marker in which the position of the active element is stabilized relative to the marker housing and/or the bias element.

According to an aspect of the invention, there is provided a magnetomechanical EAS marker, including a housing for defining a cavity, a magnetostrictive metal strip in the cavity and having soft magnetic properties, and structure for securing the central portion of the magnetostrictive strip to the housing. The securing structure may include an adhesive substance, or may be formed of interacting mechanical attributes of the housing and the magnetostrictive strip, such as notches centrally located on the strip which are engaged by protrusions on the housing.

According to another aspect of the invention, there is provided a magnetomechanical EAS marker, including a housing for defining a cavity, a magnetostrictive metal strip in the cavity and having soft magnetic properties, a bias magnet in the housing, the bias magnet being for applying a bias magnetic field to the magnetostrictive strip, and an adhesive substance for securing a central portion of the magnetostrictive strip to the bias magnet.

According to still another aspect of the invention, there is provided a magnetomechanical EAS marker, including a housing for defining a cavity, a magnetostrictive metal strip in the cavity and having soft magnetic properties, and a spacing mechanism for maintaining a spacing between an end of the strip and the housing.

In a magnetomechanical EAS marker provided in accordance with the invention, the position of the active element relative to the bias element is stabilized, but without significantly constraining the freedom of the active element to mechanically oscillate. The stable positioning of the active element minimizes the possibility of variations in the resonant frequency of the active element due to variations in the effective applied bias field, thereby helping to assure reliable detection of the marker. In addition, the marker is arranged to prevent mechanical loading of a bottom end of the active element when the marker is in a vertical orientation, thereby preventing attenuation of the mechanical resonance of the marker and again helping to assure reliable detection of the marker.

DESCRIPTION OF PREFERRED EMBODIMENTS

Figure 1:
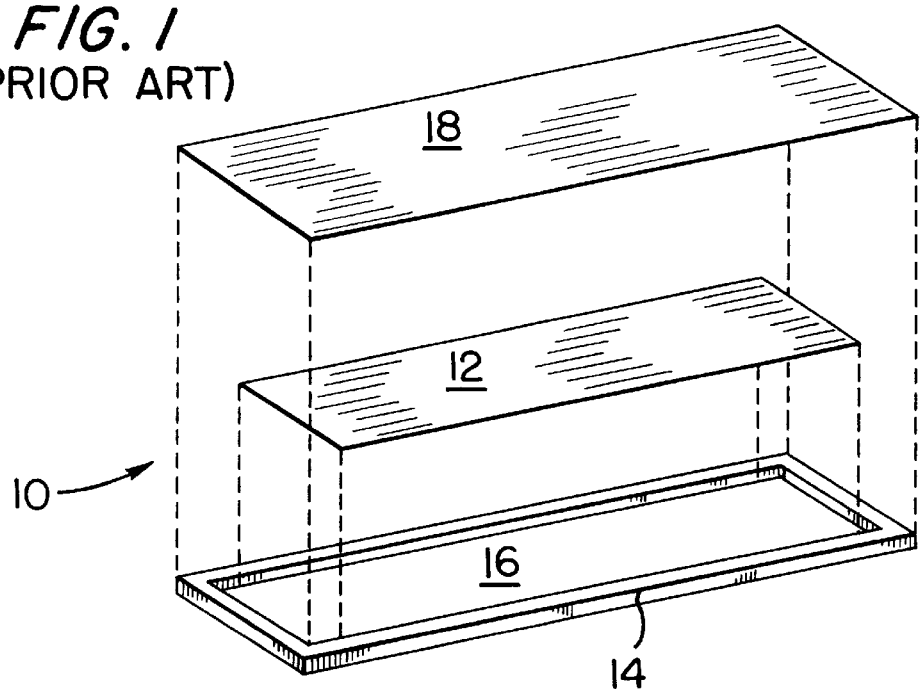
FIG. 1 (PRIOR ART)
FIG. 1 is an exploded isometric view showing components of a conventional magnetomechanical EAS marker.
Figure 2:
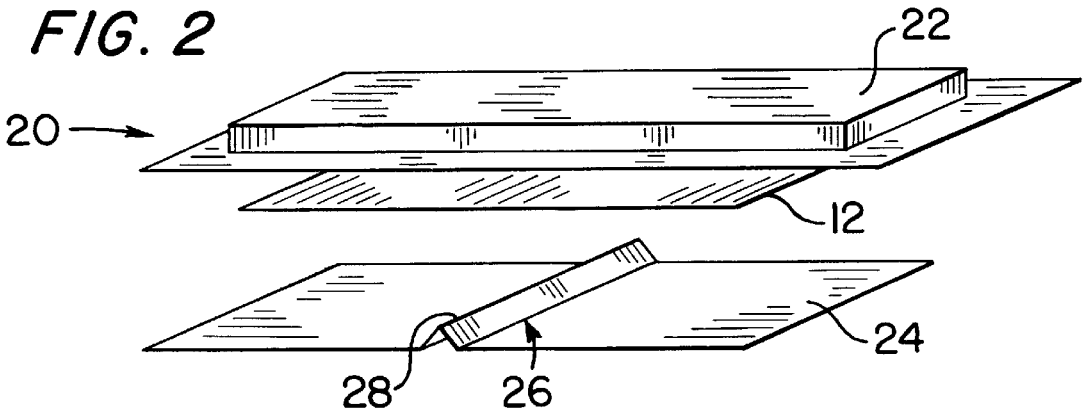
FIG. 2 is an exploded schematic representation of a magnetomechanical marker provided according to a first embodiment of the invention.

A first embodiment of the invention will now be described with reference to FIG. 2. In FIG. 2, reference numeral 20 generally indicates a magnetomechanical EAS marker provided in accordance with the invention. Reference numeral 12 again indicates an active magnetostrictive element, which may be of the same type as active elements conventionally employed in magnetomechanical markers.

A housing component of the marker 20 is formed of an upper member 22 and a lower member 24. A bias element, which is not separately shown, may be mounted by conventional means to the top surface of the upper housing member 22 or to the bottom surface of the lower housing member 24.

A ridge 26 is formed as an indentation in the lower housing member 24 and extends upwardly, and transversely relative to the length of the marker, at a central portion of member 24. An adhesive substance is applied to the peak 28 of the ridge 26 to secure a central portion of the active element 12 to the ridge 26.

It will be appreciated that the center of the active element 12 is the node of the mechanical vibration of the active element 12. It has been found that securing the active element 12 to the marker housing at the central portion of the active element causes only a small reduction, on the order of about 5%, in the amplitude of the signal output by the active element. To assure minimal reduction in the output signal amplitude, the width of the adhesive (i.e. the dimension of the adhesive in the direction of the length of the marker) should be limited to about 1 mm.

The adhesive which secures the active element 12 to the ridge 26 should be of a "non-aggressive" type, i.e. an adhesive that does not shrink or change dimension when curing, so that no stress is applied to the active element 12 by curing of the adhesive, and to avoid clamping effects. Adhesives such as rubber cement or silicone-rubber sealant may be used.

The active element remains free to mechanically oscillate in response to an interrogation signal generated by EAS detection equipment, but is secured in a fixed position relative to the housing so that the active element 12 does not shift longitudinally relative to the housing or relative to the bias element, and spacing is maintained in a longitudinal direction between the housing and the ends of the active element. As a result, the marker shown in FIG. 2 does not suffer either from variations in resonant frequency because of longitudinal shifting by the active element relative to the bias element, or from diminution in output signal amplitude caused by mechanical loading of the end of the active element when the marker is in a vertical orientation.

Figure 3:
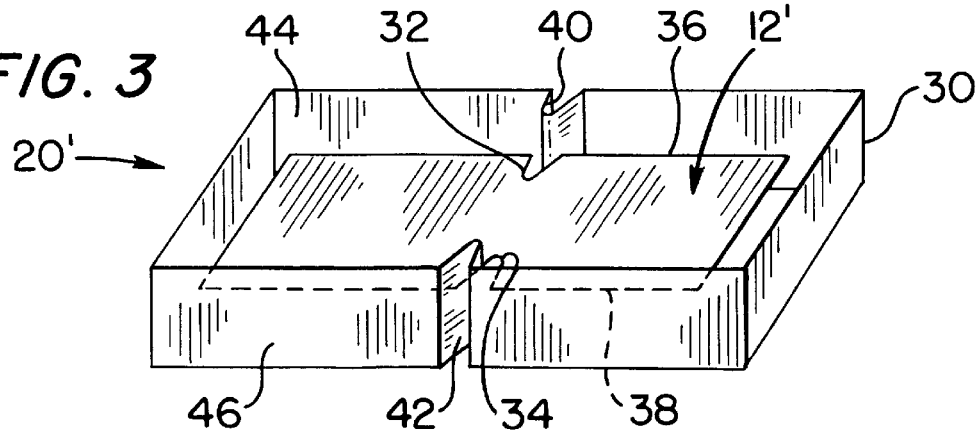
FIG. 3 is a schematic isometric view of a magnetomechanical marker provided according to a second embodiment of the invention.

FIG. 3 schematically shows another embodiment of the invention. Reference numeral 20' generally indicates a magnetomechanical marker according to this embodiment. In the marker 20', an active element 12' is maintained in a substantially fixed position relative to a marker housing 30 without using adhesive.

Notches indicated at 32 and 34 are formed respectively at central portions of long edges 36, 38 of the active element 12'. The notches 32, 34 of the active element 12' are respectively engaged by protrusions 40, 42 which extend inwardly from respective long sides 44, 46 of the marker housing 30. A bias element, which is not separately shown, may be affixed to the top surface or bottom surface of the marker housing 30.

The interaction of the active element notches and the marker housing protrusions maintains the active element 12' in a substantially fixed position relative to the marker housing 30 and the bias element. As in the embodiment of FIG. 2, the active element 12' is prevented from shifting longitudinally relative to the bias element, and also has its ends maintained in a spaced condition from the housing, even when the marker is in a vertical orientation.

Figure 4:
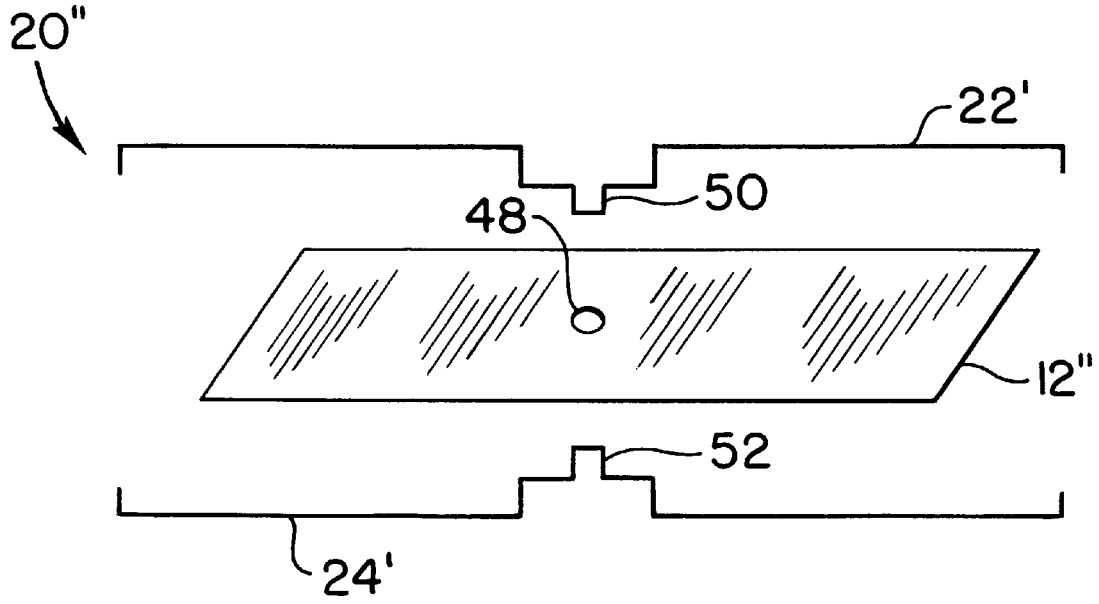
FIG. 4 is a schematic view of a magnetomechanical marker according to a third embodiment of the invention.

A third embodiment of the invention is schematically illustrated in FIG. 4, in which reference numeral 20" generally indicates a magnetomechanical marker according to this embodiment.

In the marker 20" an active element 12" has an aperture 48 drilled or etched at the center of the active element. A pin protrusion 50 extends downwardly from a central point of an upper housing member 22'. A pin protrusion 52 extends upwardly from a central point of a lower housing member 24'. It will be understood that the housing members 22' and 24' are to be mated to form a marker housing, and that the pin protrusions 50 and 52 meet to form a shaft which is engaged by the aperture 48 of the active element 12" to secure the active element in a substantially fixed position relative to the housing formed by the members 22', 24'. As before, a bias element, which is not separately shown, may be fixedly mounted to the top of the upper member 20' or to the bottom of the lower member 24'. As in the previously-described embodiments, longitudinal shifting of the active element relative to the bias element is prevented, as is edge loading of the active element when the marker is vertically oriented.

Figure 5:
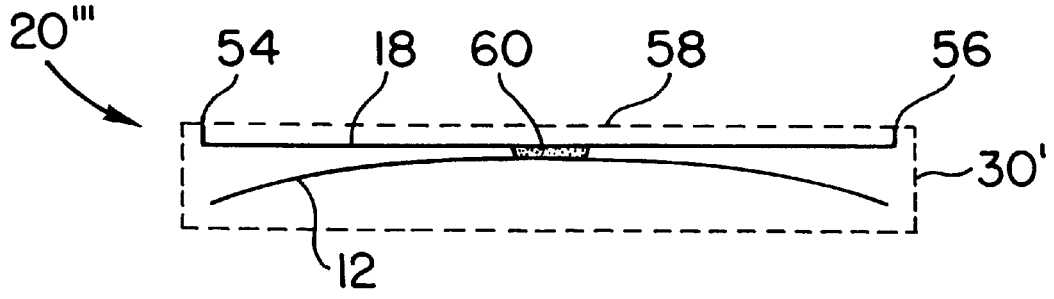
FIG. 5 is a schematic side view of a magnetomechanical marker according to a fourth embodiment of the invention.

A fourth embodiment of the invention is illustrated in schematic side view in FIG. 5. Reference numeral 20'" generally indicates a magnetomechanical marker in accordance with this embodiment. The marker 20'" includes a housing 30', which may be like conventional magnetomechanical marker housings. A conventional bias element 18 is secured by any convenient means (schematically indicated at 54, 56) to an underside of the top face 58 of the marker housing 30'. The active element 12 is secured at a central portion thereof to a central portion of the bias element 18 by means of adhesive 60.

As is often the case with active elements formed as strips cut from cast amorphous ribbon, the active element 12 exhibits a curvature along its length. The curvature of active element 12, and an adequate degree of thickness of the adhesive 60, help to assure that the active element 12 does not become clamped to the bias element 18 by the magnetic attraction between the elements 18 and 12.

As in previous embodiments, the active element 12 in marker 20'" is held in a fixed position relative to the bias element 18, and the ends of the active element 12 are kept spaced apart from the housing 30', even when the marker is in a vertical orientation.

In the above-described embodiments of the invention, it has been assumed that the active element and the bias element have been formed in accordance with known practice. It is also contemplated that the active element shown in the embodiments of FIGS. 2, 3 and 4 could be fabricated so as to be self-biasing, in accordance with the teachings of U.S. Pat. No. 5,565,849 or co-pending patent application Ser. No. 08/800,772. Of course, if a self-biasing active element is employed, then it is not necessary to include a separate bias magnet in the marker.

It should be noted that the ridge-shaped indentation 26 in the lower housing member 24 shown in FIG. 2 could be replaced by a centrally-located pin-shaped indentation to which the adhesive would be applied to secure the central portion of the active element in a fixed position.

U.S. Pat. No. 5,499,015 issued to Winkler et al. (and commonly assigned with this application), discloses the concept of integrating magnetomechanical marker components with a retail product or product packaging. According to the '015 patent, a cavity for housing a magnetostrictive active element may be integrally formed in a component of a product to be protected from theft or in packaging for the product. It is contemplated to apply the teachings of the present application in regard to stabilizing the position of the active element while leaving the active element free to undergo resonant oscillation, to the product- or packaging-integrated EAS markers of the '015 patent. Accordingly, the term "housing", as used in the appended claims, should be understood to include a component of a product or an item of packaging in which a cavity is integrally formed of a size for housing an active element.

It should also be understood that the teachings of the present invention are applicable both to "soft" magnetomechanical markers (i.e. single-use markers secured to items of merchandise by adhesive) and "hard" magnetomechanical markers (i.e., reusable markers secured to articles of clothing, etc. by means of a pin or tack).

Figure 6:
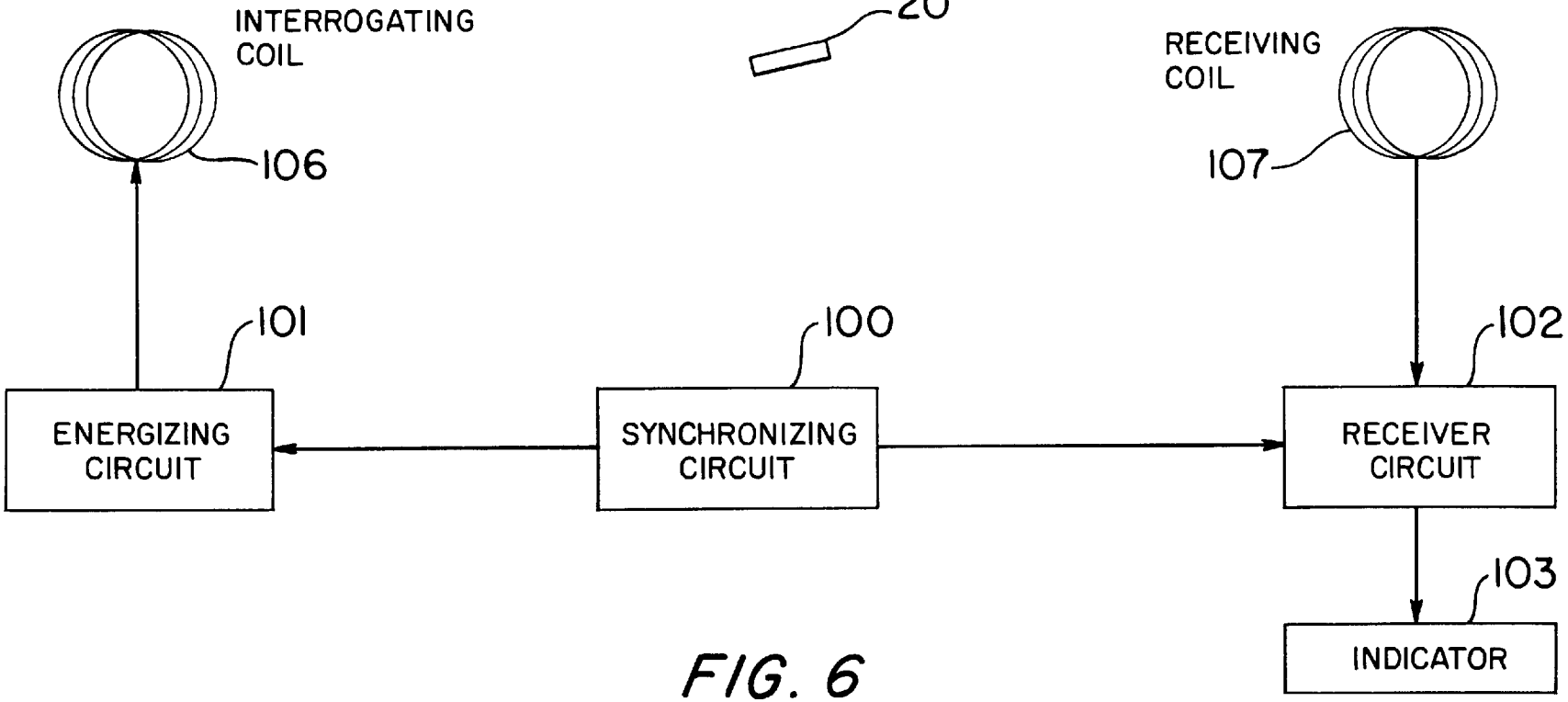
FIG. 6 is a schematic block diagram of an electronic article surveillance system which uses a magnetomechanical marker provided in accordance with the invention.

FIG. 6 illustrates a pulsed-interrogation EAS system which uses a magnetomechanical marker fabricated in accordance with the invention. The system shown in FIG. 6 includes a synchronizing circuit 100 which controls the operation of an energizing circuit 100 and a receiving circuit 102. The synchronizing circuit 100 sends a synchronizing gate pulse to the energizing circuit 101, and the synchronizing gate pulse activates the energizing circuit 101. Upon being activated, the energizing circuit 101 generates and sends an interrogation signal to interrogating coil 106 for the duration of the synchronizing pulse. In response to the interrogation signal, the interrogating coil 106 generates an interrogating magnetic field, which, in turn, excites the marker 20 into mechanical resonance. (It will be recognized that any of the markers 20, 20', 20" or 20'" disclosed herein may be employed with the EAS system of FIG. 6.)

Upon completion of the pulsed interrogation signal, the synchronizing circuit 100 sends a gate pulse to the receiver circuit 102, and the latter gate pulse activates the circuit 102. During the period that the circuit 102 is activated, and if a marker is present in the interrogating magnetic field, such marker will generate in the receiver coil 107 a signal at the frequency of mechanical resonance of the marker. This signal is sensed by the receiver 102, which responds to the sensed signal by generating a signal to an indicator 103 to generate an alarm or the like. In short, the receiver circuit 102 is synchronized with the energizing circuit 101 so that the receiver circuit 102 is only active during quiet periods between the pulses of the pulsed interrogation field.

In all cases it is to be understood that the above-described arrangements are merely illustrative of the many possible specific embodiments which represent applications of the present invention. Numerous and varied other arrangements can be readily devised in accordance with the principles of the present invention without departing from the spirit and scope of the invention.

What is claimed is:

1. A magnetomechanical electronic article surveillance system, comprising:

(a) generating means for generating an electromagnetic field alternating at a selected frequency in an interrogation zone, said generating means including an interrogation coil;

(b) a marker secured to an article of merchandise appointed for passage through said interrogation zone, said marker including a housing for defining a cavity, a magnetostrictive metal strip in said cavity, means for securing a central portion of said magnetostrictive strip to said housing, and bias means for providing a biasing magnetic field such that said magnetostrictive strip is mechanically resonant when exposed to said alternating field; and (c) detecting means for detecting said mechanical resonance of said magnetostrictive element.

2. A magnetomechanical electronic article surveillance system according to claim 1, wherein said means for securing said central portion of said magnetostrictive strip to said housing of said marker includes an adhesive substance.

3. A magnetomechanical electronic article surveillance system according to claim 2, wherein said housing of said marker includes an indentation extending inwardly relative to said housing at a position corresponding to said central portion of said magnetostrictive strip, said adhesive being applied to an inward side of said indentation in the housing to secure said central portion of said magnetostrictive strip to said indentation.

4. A magnetomechanical electronic article surveillance system according to claim 3, wherein said indentation is a ridge which extends in a direction transverse to a longitudinal axis of said magnetostrictive strip.

5. A magnetomechanical electronic article surveillance system according to claim 1, wherein said means for securing said central portion of said magnetostrictive strip to said housing of said marker includes:

an aperture in said central portion of said magnetostrictive strip; and a pin on said housing for engaging said aperture.

6. A magnetomechanical electronic article surveillance system according to claim 1, wherein:

said magnetostrictive strip includes a first edge and a second edge, said first and second edges being substantially parallel to each other and to a longitudinal axis of the strip; and said means for securing said magnetostrictive strip to said housing of said marker includes:

two notches, each formed at a central point in a respective one of the first and second edges of said magnetostrictive strip; and protrusions on said housing for engaging said notches.

7. A magnetomechanical electronic article surveillance system according to claim 1, wherein said bias means includes a magnetized metal strip, separate from said magnetostrictive strip and mounted on said housing adjacent to said magnetostrictive strip.

8. A magnetomechanical EAS marker, comprising:

a housing for defining a cavity;

a magnetostrictive metal strip in said cavity, said strip having soft magnetic properties; and means for securing a central portion of said magnetostrictive strip to said housing.

9. A magnetomechanical EAS marker according to claim 8, wherein said means for securing includes an adhesive substance.

10. A magnetomechanical EAS marker according to claim 9, wherein said housing includes an indentation extending inwardly relative to said housing at a position corresponding to said central portion of said magnetostrictive strip, said adhesive being applied to an inward side of said indentation in the housing to secure said central portion of said magnetostrictive strip to said indentation.

11. A magnetomechanical EAS marker according to claim 10, wherein said indentation is a ridge which extends in a direction transverse to a longitudinal axis of said magnetostrictive strip.

12. A magnetomechanical EAS marker according to claim 8, wherein said means for securing includes:

an aperture in said central portion of said magnetostrictive strip; and a pin on said housing for engaging said aperture.

13. A magnetomechanical EAS marker according to claim 8, wherein:

said magnetostrictive strip includes a first edge and a second edge, said first and second edges being substantially parallel to each other and to a longitudinal axis of the strip; and said means for securing includes:

two notches, each formed at a central point in a respective one of the first and second edges; and protrusions on said housing for engaging said notches.

14. A magnetomechanical EAS marker according to claim 8, further comprising a ferromagnetic metal strip mounted to said housing to apply a bias magnetic field to said magnetostrictive strip.

15. A magnetomechanical EAS marker, comprising:

a housing for defining a cavity;

a magnetostrictive metal strip in said cavity, said strip having soft magnetic properties;

a bias magnet in said housing, said bias magnet for applying a bias magnetic field to said magnetostrictive strip; and means for securing a central portion of said magnetostrictive strip to said bias magnet.

16. A magnetomechanical EAS marker according to claim 15, wherein said means for securing is an adhesive substance.

17. A magnetomechanical EAS marker, comprising:

a housing for defining a cavity;

a magnetostrictive metal strip in said cavity, said strip having soft magnetic properties; and spacing means for maintaining a spacing between an end of said trip and said housing, wherein said spacing means includes means for securing a central portion of said magnetostrictive strip to said housing.

* * * * *